US006225016B1

(12) United States Patent
Sasaki et al.

(10) Patent No.: US 6,225,016 B1
(45) Date of Patent: May 1, 2001

(54) PHOTOCONDUCTOR FOR ELECTROPHOTOGRAPHY AND A METHOD OF MANUFACTURING THE SAME

(75) Inventors: Teruo Sasaki; Yoichi Nakamura, both of Nagano (JP)

(73) Assignee: Fuji Electric Imaging Device Co., Ltd. (JP)

( * ) Notice: Subject to any disclaimer, the term of this patent is extended or adjusted under 35 U.S.C. 154(b) by 0 days.

(21) Appl. No.: 09/645,945

(22) Filed: Aug. 25, 2000

(30) Foreign Application Priority Data

Aug. 26, 1999 (JP) ..... 11-240174

(51) Int. Cl.[7] ..... G03G 5/06

(52) U.S. Cl. ..... 430/78; 430/76; 430/83; 430/134

(58) Field of Search ..... 430/76, 78, 83, 430/134

(56) References Cited

U.S. PATENT DOCUMENTS 4,515,881 * 5/1985 Sawada et al. ..... 430/78
4,551,404 * 11/1985 Hiro et al. ..... 430/78

FOREIGN PATENT DOCUMENTS 62-242957 * 10/1987 (JP) ..... 430/76
63-169648 * 7/1988 (JP) ..... 430/76
1-97965 * 4/1989 (JP) ..... 430/76
3-129357 * 6/1991 (JP) ..... 430/76

* cited by examiner

*Primary Examiner*—Roland Martin
(74) *Attorney, Agent, or Firm*—Morrison Law Firm

(57) ABSTRACT

A photoconductor for electrophotography includes a photosensitive film containing a bisazo charge generation agent described by structural formula (I)

(I)

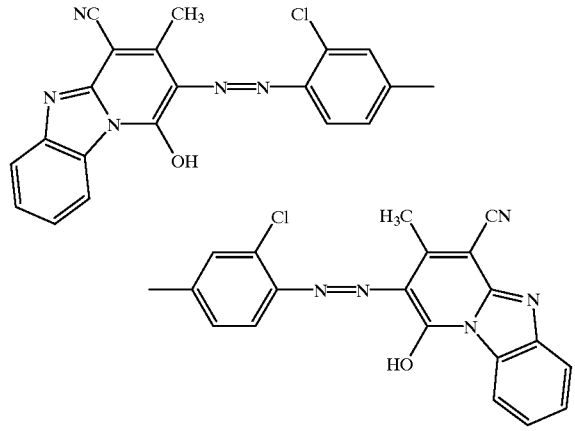

and from 100 nmol to 40 mmol, preferably from 500 nmol to 20 mmol, of a compound described by a structural formula (II)

(II)

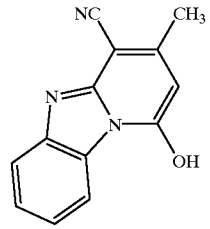

with respect to 1 mol of the bisazo charge generation agent. Such a photoconductor for electrophotography minimizes visual defects and image nonuniformity.

4 Claims, No Drawings

PHOTOCONDUCTOR FOR ELECTROPHOTOGRAPHY AND A METHOD OF MANUFACTURING THE SAME

BACKGROUND OF THE INVENTION

The present invention relates to a photoconductor for electrophotography, hereinafter referred to simply as a "photoconductor", used in electrophotographic apparatuses such as printers, copying machines and facsimiles. More specifically, the present invention relates to a photoconductor that includes a photosensitive film containing a specific bisazo compound as a charge generation agent.

Conventional photoconductors include an electrically conductive substrate and a photosensitive film on the electrically conductive substrate. It is necessary for the photosensitive film to retain surface charges in the dark, to generate charges in response to the received light, and to transport charges in response to the received light. The so-called single-layer-type photoconductor includes a mono-layered photosensitive film that exhibits all the above described functions. The so-called laminate-type photoconductor includes a photosensitive laminate film including a charge generation layer that contributes mainly to charge generation and a charge transport layer that contributes to surface charge retention in the dark and to charge transport under light exposure.

The photoconductive materials for the photoconductor includes inorganic photoconductive materials such as selenium, selenium alloys, zinc oxide, and cadmium sulfide. The selenium film or the selenium alloy film is formed by vacuum deposition. Small grains of zinc oxide or cadmium sulfide are dispersed into an organic solvent, in that a resin binder is dissolved, and the organic solvent is used as a coating liquid. The photoconductive materials for the photoconductor also includes organic photoconductive materials such as poly-N-vinylcarbazole, poly(vinyl anthracene), phthalocyanine compounds and bisazo compounds. The poly-N-vinylcarbazole solution or the poly(vinyl anthracene) solution is used as a coating liquid. A film of a phthalocyanine compound or a film of a bisazo compound is formed by vacuum deposition. Optionally, small grains of a phthalocyanine compound or a bisazo compound are dispersed into an organic solvent, in that a resin binder is dissolved, and the organic solvent is used as a coating liquid.

When a bisazo compound is used as a charge generation agent to form a single-layer-type photoconductor or a laminate-type photoconductor, usually small grains of the bisazo compound are dispersed into an organic solvent, into which an appropriate resin binder is dissolved. Visual defects and image nonuniformity are caused when the bisazo compound grains are not so small enough as to be dispersed uniformly. Various investigations have been conducted on the influences of the kinds and the amounts of the impurities on the grain size and the dispersibility of the bisazo compound.

Among many bisazo compounds, a bisazo compound described by a structural formula (I) (hereinafter referred to as "DCPB")

(I)

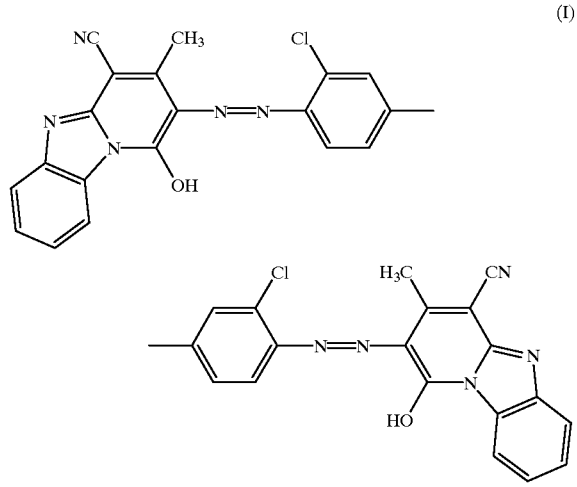

is used as a charge generation agent that provides the photoconductors with preferable electrical properties such as high sensitivity and a low residual potential (cf Japanese Unexamined Laid Open Patent Application No. S63-305362).

DCPB is synthesized by the method disclosed in Japanese Unexamined Laid Open Patent Application No. H01-282268. In many cases, DCPB is synthesized using a compound described by a structural formula (II) (hereinafter referred to as "PB").

(II)

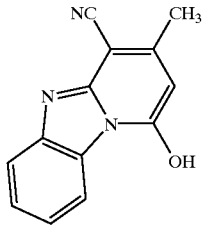

As described above, it has been known to those skilled in the art that DCPB is a preferable charge generation agent. As a consequence, various investigations have been conducted on synthesis of DCPB and its purification. However, it has not yet been clarified that there exists a certain material that relates closely to the preferable grain diameter of DCPB and its preferable dispersibility which are favorable to obtain a uniform and even coating film of DCPB.

OBJECTS AND SUMMARY OF THE INVENTION

It is an object of the invention to provide a photoconductor, including a photosensitive film, that overcomes the foregoing problems.

It is a further object of the present invention to provide a photoconductor, including a photosensitive film, that contains small-grained and uniformly dispersed DCPB as a charge generation agent.

It is another object of the invention to provide a photoconductor, containing DCPB uniformly in the photosensitive film, that does not cause any visual defect nor image nonuniformity, that might otherwise be caused by nonuniform distribution of DCPB in the photosensitive film.

It is still another object of the invention to provide a method of manufacturing such an excellent photoconductor.

Briefly stated, the present invention provides a photoconductor for electrophotography which includes a photosensitive film containing a bisazo charge generation agent described by structural formula (I)

(I)

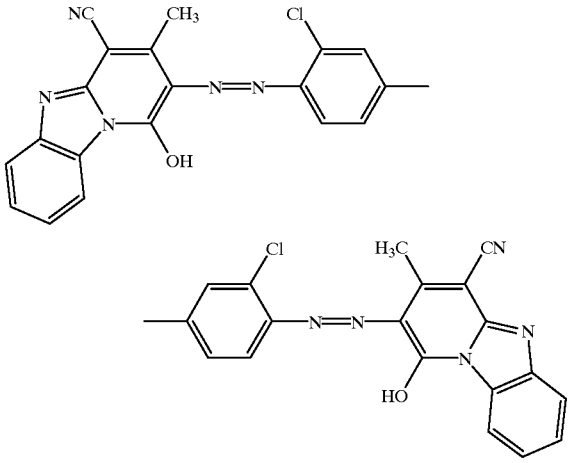

and from 100 nmol to 40 mmol, preferably from 500 nmol to 20 mmol, of a compound described by a structural formula (II)

(II)

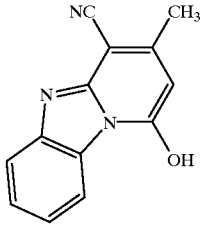

with respect to 1 mol of the bisazo charge generation agent. Such a photoconductor for electrophotography minimizes visual defects and image nonuniformity.

According to an aspect of the invention, there is provided a photoconductor for electrophotography including an electrically conductive substrate; and a photosensitive film on the electrically conductive substrate; the photosensitive film containing a bisazo charge generation agent described by the structural formula (I) and from about 100 nmol to about 40 mmol of the compound described by the structural formula (II) with respect to 1 mol of the bisazo charge generation agent.

Preferably, the photosensitive film contains from about 500 nmol to about 20 nmol of the compound described by the structural formula (II) with respect to 1 mol of the bisazo charge generation agent.

PB is used very often as a raw material for synthesizing DCPB. PB is yielded also as a byproduct of DCPB synthesis and remains as an impurity in synthesized DCPB. As a result of extensive and intensive investigations conducted to obviate the foregoing problems, the inventors of the present invention have found that limiting the PB content in DCPB within the foregoing specific range reduces the grain diameter of DCPB, disperses DCPB uniformly in the photosensitive film, and prevents visual defects and image nonuniformity due to nonuniform distribution of DCPB in the photosensitive film from forming.

The mechanisms for reducing the DCPB grain diameter and for improving the dispersibility of DCPB by limiting the PB content in DCPB within a certain range have not yet been clarified. However, while not limiting to any one theory, it is considered, when the PB content exceeds 40 mmol, the DCPB small grains coagulate with each other to elongate the grain diameters thereof and to impair the dispersibility thereof, since PB contained in DCPB weakens the electric repulsion between the DCPB small crystals. It is also considered, when the PB content is less than 100 nmol, that the DCPB small grains also coagulate with each other to elongate the grain diameters thereof and to impair the dispersibility thereof, since DCPB is so pure that crystallization of DCPB is prompted.

PB is removed easily from DCPB by purification, since PB is dissolved easily in organic solvents such as acetonitrile and N,N-dimethylformamide. Therefore, the PB content is adjusted easily by sufficiently purifying synthesized DCPB with any of the organic solvents described above and, then, by adding a necessary amount of PB to purified DCPB. Alternatively, PB remaining after synthesizing DCPB or by-product PB may be utilized.

According to another aspect of the invention, there is provided a method of manufacturing a photoconductor for electrophotography, including an electrically conductive substrate and a photosensitive film on the electrically conductive substrate, the method including the steps of: preparing a coating liquid containing a bisazo charge generation agent described by the structural formula (I) and from about 100 nmol to about 40 mmol of a compound described by the structural formula (II) with respect to 1 mol of the bisazo charge generation agent; and coating the coating liquid on the electrically conductive substrate to form the photosensitive film.

Preferably, the coating liquid contains from about 500 nmol to about 20 nmol of the compound described by the structural formula (II) with respect to 1 mol of the bisazo charge generation agent.

DETAILED DESCRIPTION OF THE INVENTION

Photoconductors may be classified into a negative-electrification- and laminate-type one, a positive-electrification- and laminate-type one, and a positive-electrification- and single-layer-type one. Usually, the negative-electrification- and laminate-type photoconductor includes a photosensitive film including a charge generation layer on an electrically conductive substrate, and a charge transport layer on the charge generation layer. The positive-electrification- and laminate-type photoconductor includes a photosensitive film including a charge transport layer on an electrically conductive substrate, and a charge generation layer on the charge transport layer. The positive-electrification- and single-layer-type photoconductor includes a mono-layered photosensitive film containing a charge generation agent and a charge transport agent. In any type of photoconductor, an undercoating film may be interposed between the substrate and the photosensitive film, if necessary. The characteristic feature of the present invention is to use a specific bisazo compound as a charge generation agent in the photosensitive film. Therefore, the invention is applicable effectively to all the types of photoconductors. In the following, the invention will be explained in connection with the negative-electrification- and laminate-type photoconductor.

Except for the materials and the processes for forming the photosensitive film containing a specific bisazo compound according to the invention, appropriate conventional materials and processes are employable for manufacturing the photoconductor of the invention.

The electrically conductive substrate works as an electrode of the photoconductor and a support of the other layers. The substrate may be shaped with a cylindrical tube, plate or a film. The substrate may be made of a metallic stuff such as aluminum, stainless steel and nickel or an insulative stuff such as glass and resin, the surface of which is treated so that it may be electrically conductive.

The undercoating film is a coating film of polyamide soluble to alcohol aromatic polyamide soluble to solvent, thermosetting urethane resin, and such resins. Preferable polyamide soluble to alcohol includes copolymers of nylon 6, nylon 8, nylon 12, nylon 66, nylon 610 and nylon 612; N-alkylated nylon; and N-alkoxyalkylated nylon. In more detail, the commercial products of these preferable compounds include Amilan CM-8000 (a nylon copolymer of nylon 6, nylon 66, nylon 610 and nylon 12, supplied from TORAY INDUSTRIES, INC.); Elbamide 9061 (a nylon copolymer of nylon 6, nylon 66 and nylon 610, supplied from Du Pont Japan Co., Ltd.); and DIAMIDE T-170 (a nylon copolymer mainly of nylon 12, supplied from Daicel Hules Ltd.). If necessary, small grains of inorganic materials such as $TiO_2$, alumina, calcium carbonate, and silica may be added to the undercoating film.

The charge generation layer is formed by coating a dispersion liquid obtained by dispersing a charge generation agent into an organic solvent, in that a resin binder is dissolved. It is important for the charge generation layer to generate charge carriers with a high efficiency and to inject the generated charges efficiently to the charge transport layer with little electric field dependence and even under a low electric field.

According to the invention, DCPB, that contains preferably from 100 nmol to 40 mmol, more preferably from 500 nmol to 20 mmol, of PB with respect 1 mol of DCPB, is used as a charge generation agent. PB is soluble to organic solvents such as acetonitrile and N,N-dimethylformamide. Therefore, the PB content is adjusted easily by sufficiently purifying synthesized DCPB with any of the organic solvents described above and, then, by adding a necessary amount of PB to purified DCPB. Alternatively, the purification is stopped at a certain intermediate stage, and PB remaining after the DCPB synthesis or by-product PB within the above described preferable content range may be utilized.

Polymers of polycarbonate, polyester, polyamide, polyurethane, epoxy, poly(vinyl butyral), phenoxy, silicone and methacrylate; copolymers of these polymers; halides of these polymers and copolymers; and cyanoethyl compounds are used alone or in an appropriate combination for the resin binder of the charge generation layer. The charge generation layer contains preferably from 10 to 5000 weight parts, more preferably from 50 to 1000 weight parts, of a charge generation agent with respect to 100 weight parts of any of the resin binders described above.

The thickness of the charge generation layer, determined by the optical absorbance of the charge generation agent, is usually 5 $\mu$m or less, and, preferably, 1 $\mu$m or less.

A pigment or a dye such as phthalocyanine compounds, quinone compounds, indigo compounds, cyanine compounds, squalane compounds, and azulenium compounds may be added to the charge generation layer. A charge transport agent may be added also to the charge generation layer.

The charge transport layer is formed by coating a dispersion liquid obtained by dispersing a charge transport agent into an organic solvent, in that a resin binder is dissolved. Various hydrazone compounds, styryl compounds, amine compounds, and their derivatives are used alone or in an appropriate combination for the charge transport agent. The charge transport layer works as an insulator layer for retaining the charges of the photoconductor in the dark and for transporting the charges injected from the charge generation layer in response to light exposure. Polymers such as polycarbonate, polyester, polystyrene and methacrylate, mixtures of these polymers, and copolymers of these polymers are used for the resin binder of the charge transport layer. It is necessary for the resin binder of the charge transport layer to exhibit excellent chemical stability, excellent electrical stability, excellent adhesiveness to the charge generation layer and excellent affinity to the charge transport agent. Preferably, the charge transport layer contains from 20 to 500 weight parts, more preferably from 30 to 300 weight parts, of the charge transport agent with respect to 100 weight parts of the resin binder. The charge transport layer is preferably from 3 to 50 $\mu$m, more preferably from 15 to 40 $\mu$m, in thickness to keep the surface potential ofthe photoconductor at a practically effective level.

The photoconductor according to the invention includes a conductive substrate, a charge generation layer, containing DCPB and from 100 nmol to 40 mmol, more preferably from 500 nmol to 20 mmol, of PB with respect 1 mol of DCPB, on the conductive substrate, and a charge transport layer on the charge generation layer. If necessary, an undercoating film is interposed between the substrate and the charge generation layer. The photoconductor according to the invention facilitates preventing visual defects and image nonuniformity, which might otherwise be caused by nonuniform distribution of DCPB in the photosensitive film, from causing.

EMBODIMENTS

Although the present invention will be explained hereinafter in connection with the preferred embodiments thereof, changes and modifications are obvious to those skilled in the art without departing from the gist of the invention. Therefore, the invention be understood not by the specific disclosures herein but only by the appended claims thereof.

First Embodiment (E1)

A coating liquid for the undercoating film was prepared by mixing 70 weight parts of a polyamide resin (Amilan CM8000 supplied from TORAY INDUSTRIES, INC.) and 930 weight parts of methanol (supplied from Wako Pure Chemical Industries, Ltd.). The coating liquid was coated by dip-coating on an aluminum alloy substrate and dried, resulting in an undercoating film. The resulting undercoating film was 0.5 $\mu$m in thickness.

The steps of washing DCPB (synthesized in Fuji Electric Co., Ltd.) with N,N-dimethylformamide (supplied from Wako Pure Chemical Industries, Ltd.), filtering washed DCPB and drying filtered DCPB under vacuum were repeated three times, resulting in purified DCPB. One hundred nmol of PB synthesized by the method disclosed in Japanese Unexamined Laid Open Patent Application No. H01-282268 was added to 1 mol of purified DCPB to obtain a charge generation agent mixture. A coating liquid for the charge generation layer was prepared by mixing 6.5 weight parts of the charge generation agent mixture, 3.5 weight parts of apoly(vinyl acetal) resin (KS-1 supplied from Sekisui Chemical Co., Ltd.) and 90 weight parts of dichloromethane (supplied from Wako Pure Chemical Industries, Ltd.), The coating liquid was dispersed by ultrasonic dispersion. The coating liquid was coated on the undercoating film, by dip-coating, and dried, resulting in a charge generation layer. The resulting charge generation layer was 0.2 μm in thickness.

A coating liquid for the charge transport layer was prepared by mixing 100 weight parts of 4-(diphenylamino) benzaldehydephenyl(2-thyenylmethyl) hydrazone (synthesized in Fuji Electric Co., Ltd.), 100 weight parts of a polycarbonate resin (Panlite K-1300 supplied from TEIJIN LTD.), 800 weight parts of dichloromethane (supplied from Wako Pure Chemical Industries, Ltd.), 1 weight part of a silane coupling agent (KP-340 supplied from Shin-Etsu Chemical Co., Ltd.), and 4 weight parts of bis(2,4,-di-tert-butylphenyl)phenylphosphonite (synthesized in Fuji Electric Co., Ltd.). The coating liquid was coated on the charge generation layer, by dip-coating, and dried, resulting in a charge transport layer. The resulting charge transport layer was 20 μm in thickness. Thus, a photoconductor (E1) according to a first embodiment of the invention was fabricated.

Second Embodiment (E2)

A photoconductor (E2) according to a second embodiment ofthe invention was fabricated in the same way as the photoconductor (E1) according to the first embodiment except that 10 μmol of PB was added to 1 mol of DCPB in the charge generation layer of the photoconductor (E2).

Third Embodiment (E3)

A photoconductor (E3) according to a third embodiment of the invention was fabricated in the same way as the photoconductor (E1) according to the first embodiment except that 1 mmol of PB was added to 1 mol of DCPB in the charge generation layer of the photoconductor (E3).

Fourth Embodiment (E4)

A photoconductor (E4) according to a fourth embodiment of the invention was fabricated in the same way as the photoconductor (E1) according to the first embodiment except that 40 mmol of PB was added to 1 mol of DCPB in the charge generation layer of the photoconductor (E4).

Comparative Example 1 (C1)

A photoconductor (C1) according to a comparative example 1 of the invention was fabricated in the same way as the photoconductor (E1) according to the first embodiment except that 50 nmol of PB was added to 1 mol of DCPB in the charge generation layer of the comparative photoconductor (C 1).

Comparative Example 2 (C2)

A photoconductor (C2) according to a comparative example 2 of the invention was fabricated in the same way as the photoconductor (E1) according to the first embodiment except that 60 mmol of PB was added to 1 mol of DCPB in the charge generation layer of the comparative photoconductor (C2).

In the photoconductors according to the first through fourth embodiments, visual defects and image nonuniformity, caused by nonuniform dispersion of the charge generation agent in the charge generation layer, are not observed. However, visual defects and image nonuniformity are observed in the photoconductors according to the comparative examples 1 and 2.

Table 1 lists the grain diameters of DCPB dispersed in the coating liquids for the charge generation layers. The grain diameters are measured with a grain size distribution analyzer (B1-90 supplied from BROOKHAVEN CO., LTD.) immediately before coating the charge generation layers.

TABLE 1

| Photoconductors | Grain diameters of DCPB (nm) |
|---|---|
| E 1 | 130 |
| E 2 | 122 |
| E 3 | 165 |
| E 4 | 170 |
| C 1 | 387 |
| C 2 | 421 |

As the results described in Table 1 indicate, the DCPB grain diameters in the coating liquids for the respective charge generation layers according to the embodiments are small, indicating uniform dispersion of DCPB in the coating liquids for the respective charge generation layers. In contrast, the DCPB grain diameters in the coating liquids for the respective charge generation layers according to the comparative examples are large, indicating nonuniform dispersion of DCPB in the coating liquids for the respective charge generation layers. The nonuniform dispersion of DCPB in the coating liquids causes nonuniform dispersion of DCPB in the charge generation layers, resulting in advantages of the photoconductors according to the embodiments and disadvantages of the photoconductors according to the comparative examples.

Fifth Embodiment (E5)

A photoconductor (E5) according to a fifth embodiment of the invention was fabricated in the same way as the photoconductor (E1) according to the first embodiment except that the coating liquid for the charge transport layer was stored for 3 days before fabricating the photoconductor (E5).

Sixth Embodiment (E6)

A photoconductor (E6) according to a sixth embodiment of the invention was fabricated in the same way as the photoconductor (E5) according to the fifth embodiment except that 10 μmol of PB was added to 1 mol of DCPB in the charge generation layer of the photoconductor (E6).

Seventh Embodiment (E7)

A photoconductor (E7) according to a seventh embodiment of the invention was fabricated in the same way as the photoconductor (E5) according to the fifth embodiment except that 1 mmol of PB was added to 1 mol of DCPB in the charge generation layer of the photoconductor (E7).

Eighth Embodiment (E8)

A photoconductor (E8) according to an eighth embodiment of the invention was fabricated in the same way as the photoconductor (E5) according to the fifth embodiment except that 40 mmol of PB was added to 1 mol of DCPB in the charge generation layer of the photoconductor (E8).

Comparative Example 3 (C3)

A photoconductor (C3) according to a comparative example 3 of the invention was fabricated in the same way as the photoconductor (E5) according to the fifth embodiment except that 50 nmol of PB was added to 1 mol of DCPB in the charge generation layer of the comparative photoconductor (C3).

Comparative Example 4 (C4)

A photoconductor (C4) according to a comparative example 4 of the invention was fabricated in the same way as the photoconductor (E5) according to the fifth embodiment except that 60 mmol of PB was added to 1 mol of DCPB in the charge generation layer of the comparative photoconductor (C4).

In the photoconductors according to the fifth through eighth embodiments, visual defects and image nonuniformity, caused by nonuniform dispersion of the charge generation agent in the charge generation layer, are not observed. However, visual defects and image nonuniformity are observed in the photoconductors according to the comparative examples 3 and 4. The visual defects and image nonuniformity in the photoconductors according to the comparative examples 3 and 4 are worse than those in the photoconductors according to the comparative examples 1 and 2.

Table 2 lists the grain diameters of DCPB dispersed in the coating liquids for the charge generation layers. The grain diameters are measured with a grain size distribution analyzer (B1-90 supplied from BROOKHAVEN CO., LTD.) after storing the coating liquids for 3 days.

TABLE 2

| Photoconductors | Grain diameters of DCPB (nm) |
|---|---|
| E 5 | 134 |
| E 6 | 132 |
| E 7 | 175 |
| E 8 | 171 |
| C 3 | 452 |
| C 4 | 508 |

As the results described in comparing Tables 1 and 2, the DCPB grain diameters in the coating liquids for the respective charge generation layers according to the embodiments are almost unchanged by the storage for 3 days. Furthermore, the grain diameters in the coating liquids for the respective charge generation layers, according to the embodiments of the present invention, of DCPB are small, indicating uniform dispersion of DCPB in the coating liquids for the respective charge generation layers. In contrast, the DCPB grain diameters in the coating liquids for the respective charge generation layers according to the comparative examples are larger after the storage for 3 days than those before the storage. The storage for 3 days causes coagulation of DCPB in the coating liquids according to the comparative examples and increases the grain diameters, resulting in more nonuniform dispersion of DCPB in the coating liquids according to the comparative examples. The more nonuniform dispersion of DCPB finally causes worse visual defects and image nonuniformity in the photoconductors according to the comparative examples 3 and 4.

Ninth Embodiment (E9)

A photoconductor (E9) according to a ninth embodiment of the invention was fabricated in the same way as the photoconductor (E1) according to the first embodiment except that N,N-dimethylformamide used for the solvent for purifying DCPB in the first embodiment was changed to acetonitrile in fabricating the photoconductor (E9) according to the ninth embodiment.

Tenth Embodiment (E10)

A photoconductor (E10) according to a tenth embodiment of the invention was fabricated in the same way as the photoconductor (E9) according to the ninth embodiment except that 10 $\mu$mol of PB is added to 1 mol of DCPB in the charge generation layer of the photoconductor (E10).

Eleventh Embodiment (E11)

A photoconductor (E11) according to an eleventh embodiment of the invention was fabricated in the same way as the photoconductor (E9) according to the ninth embodiment except that 1 mmol of PB was added to 1 mol of DCPB in the charge generation layer of the photoconductor (E11).

Twelfth Embodiment (E12)

A photoconductor (E12) according to a twelfth embodiment ofthe invention was fabricated in the same way as the photoconductor (E9) according to the ninth embodiment except that 40 mmol of PB was added to 1 mol of DCPB in the charge generation layer of the photoconductor (E12).

Comparative Example 5 (C5)

A photoconductor (C5) according to a comparative example 5 of the invention was fabricated in the same way as the photoconductor (E9) according to the ninth embodiment except that 50 nmol of PB was added to 1 mol of DCPB in the charge generation layer of the comparative photoconductor (C5).

Comparative Example 6 (C6)

A photoconductor (C6) according to a comparative example 6 of the invention was fabricated in the same way as the photoconductor (E9) according to the ninth embodiment except that 60 mmol of PB was added to 1 mol of DCPB in the charge generation layer of the comparative photoconductor (C6).

In the photoconductors according to the ninth through twelfth embodiments, visual defects and image nonuniformity, caused by nonuniform dispersion of the charge generation agent in the charge generation layer, are not observed. However, visual defects and image nonuniformity are observed in the photoconductors according to the comparative examples 5 and 6.

Table 3 lists the grain diameters of DCPB dispersed in the coating liquids for the charge generation layers. The grain diameters are measured with a grain size distribution analyzer (B1-90 supplied from BROOKHAVEN CO., LTD.) immediately before coating the charge generation layers.

TABLE 3

| Photoconductors | Grain diameters of DCPB (mn) |
|---|---|
| E 9 | 133 |
| E 10 | 136 |
| E 11 | 148 |
| E 12 | 161 |
| C 5 | 405 |
| C 6 | 457 |

As the results described in Table 3 indicate, the DCPB grain diameters in the coating liquids for the respective charge generation layers according to the embodiments are small, indicating uniform dispersion of DCPB in the coating liquids for the respective charge generation layers. In contrast, the DCPB grain diameters in the coating liquids for the respective charge generation layers according to the comparative examples are large, indicating nonuniform dispersion of DCPB in the coating liquids for the respective charge generation layers. The nonuniform dispersion of DCPB in the coating liquids causes nonuniform dispersion of DCPB in the charge generation layers, resulting in advantages of the photoconductors according to the embodiments and disadvantages of the photoconductors according to the comparative examples.

As the results listed in Tables 1 and 3 indicate, the same relationship between the mixing ratio of PB, the DCPB charge generation agent, and the DCPB grain diameters in the coating liquid for the respective charge generation layer is observed even when different solvents are used for purifying synthesized DCPB.

EFFECT OF THE INVENTION

As explained above, the photoconductor according to the invention, including a photosensitive film that contains a bisazo charge generation agent described by the structural formula (I) and from 100 nmol to 40 mmol, preferably from 500 nmol to 20 mmol, of the compound described by the structural formula (II) with respect to 1 mol of the bisazo charge generation agent, facilitates preventing visual defects and image nonuniformity, which might otherwise be caused by nonuniform distribution of the charge generation agent in the photosensitive film.

The photoconductor according to the invention is manufactured through the steps of preparing a coating liquid containing a bisazo charge generation agent described by the structural formula (I) and from 100 nmol to 40 mmol, preferably from 500 nmol to 20 mmol, of a compound described by the structural formula (II) with respect to 1 mol of the bisazo charge generation agent, and coating the coating liquid on an electrically conductive substrate to form a photosensitive film.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A photoconductor for electrophotography comprising:

an electrically conductive substrate;

a photosensitive film on said electrically conductive substrate; and said photosensitive film containing a bisazo charge generation agent described by the following structural formula (I)

(I)

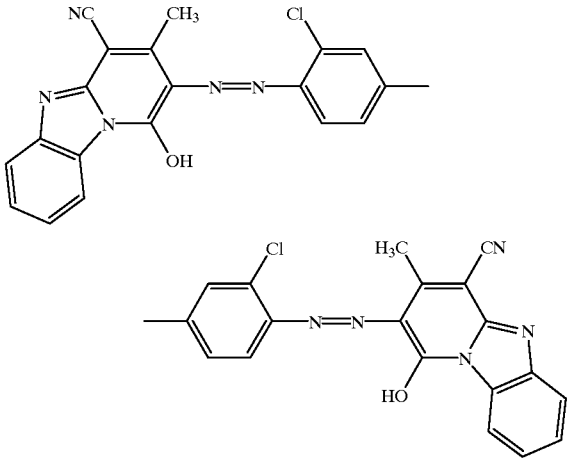

and from about 100 nmol to about 40 mmol of a compound described by the following structural formula (II)

(II)

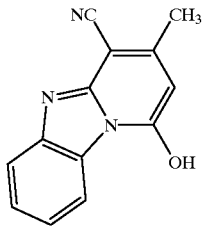

with respect to 1 mol of said bisazo charge generation agent.

2. The photoconductor for electrophotography according to claim 1, wherein said photosensitive film contains from about 500 nmol to about 20 mmol of said compound described by said structural formula (II) with respect to 1 mol of said bisazo charge generation agent.

3. A method of manufacturing a photoconductor for electrophotography, including an electrically conductive substrate and a photosensitive film on said electrically conductive substrate, the method comprising the steps of:

preparing a coating liquid containing a bisazo charge generation agent described by the following structural formula (I)

(I)

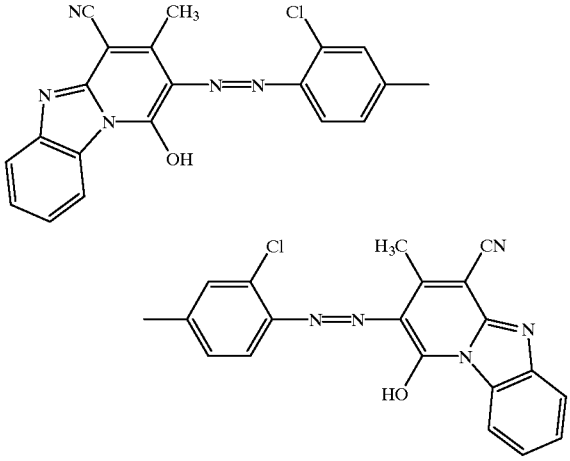

and from about 100 nmol to about 40 mmol of a compound described by the following structural formula (II)

(II)

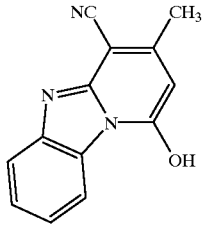

with respect to 1 mol of said bisazo charge generation agent; and coating said coating liquid on said electrically conductive substrate, whereby to form said photosensitive film.

4. The method according to claim 3, wherein said coating liquid contains from about 500 nmol to about 20 mmol of said compound described by said structural formula (II) with respect to 1 mol of said bisazo charge generation agent.

* * * * *